United States Patent [19]

McNair

[11] 3,965,495

[45] June 29, 1976

[54] HYDROTHERAPY FOOT TUB HAVING HEATING AND MASSAGING MEANS

[75] Inventor: Samuel L. McNair, Kansas City, Mo.

[73] Assignee: Dazey Products Company, Kansas City, Mo.

[22] Filed: June 2, 1975

[21] Appl. No.: 582,777

[52] U.S. Cl. ..... 4/182; 4/178; 4/179; 128/66; 128/25 B

[51] Int. Cl.[2] ..... A47K 3/022; A47K 3/10

[58] Field of Search ..... 4/182, 173, 179, 178; 128/66, 65, 25 B

[56] References Cited

UNITED STATES PATENTS

| | | | |
|---|---|---|---|
| 2,904,037 | 9/1959 | Cassidy | 4/182 X |
| 3,055,357 | 9/1962 | Radka | 128/65 X |
| 3,380,080 | 4/1968 | Farrell | 4/182 |
| 3,830,232 | 8/1974 | McNair | 128/25 B |
| 3,881,471 | 5/1975 | Grube | 128/65 |

*Primary Examiner*—Henry K. Artis
*Attorney, Agent, or Firm*—Lowe, Kokjer, Kircher, Wharton & Bowman

[57] ABSTRACT

A hollow casing presents a foot tub in which liquid is contained. An electric heating element is supported within an aluminum container which is in turn mounted within an enclosed central console on the floor of the casing. A fan cooled vibrator motor is mounted on a rigid plate which is secured to the casing a spaced distance below the floor in order to prevent side vents for cooling the motor. An upright column extends upwardly from the console to the top of the casing to provide mounting for and convenient access to a switch which controls the heating element and the motor.

7 Claims, 4 Drawing Figures

HYDROTHERAPY FOOT TUB HAVING HEATING AND MASSAGING MEANS

BACKGROUND AND SUMMARY OF THE INVENTION

This invention relates generally to a hydrotherapy unit for treating the feet of the user and is concerned more particularly with a unit which includes means for heating the water and applying a vibratory massage.

The recognized soothing effects of heated foot tubs that operate with or without an accompanying massage has led to the development of various types of hydrotherapy units in recent years. However, existing units are typically cumbersome and inconvenient to use and are usually rather expensive. A major problem has been to quickly heat the water to operating temperature while also achieving a relatively uniform water temperature in the area surrounding the feet. In addition, when existing units are used without water, hot spots tend to develop on the casing which are likely to burn the feet or ankles.

Units which include a vibrator motor have encountered difficulties in adequately cooling the motor, since it is usually mounted in a generally enclosed area within the casing. A further problem has been that the switch for the motor and heater is typically located at a relatively inaccessible position, requiring the user to assume an uncomfortable position or to step out of the tub to manipulate the switch.

It is therefore an important object of the present invention to provide a hydrotherapy foot tub which includes improved heating means for quickly and evenly heating the liquid contained in the tub.

In conjunction with the preceding object, it is another object of the invention to provide a heated foot tub which eliminates potential burn hazards when used without liquid.

Another object of the invention is to provide a foot tub of the character described which includes a vibrator motor assembly that is adequately vented to insure effective cooling of the motor.

An additional object of the invention is to provide, in a foot tub of the character described, a single switch which is conveniently accessible for controlling the heater and vibrator motor.

Still another object of the invention is to provide a foot tub in which the operating components are readily accessible for maintenance purposes.

Other and further objects of the invention, together with the features of novelty appurtenant thereto will appear in the course of the following description.

DETAILED DESCRIPTION OF THE INVENTION

In the accompanying drawings which form a part of the specification and are to be read in conjunction therewith, and in which like reference numerals are employed to indicate like parts in the various views.

Figure 1:
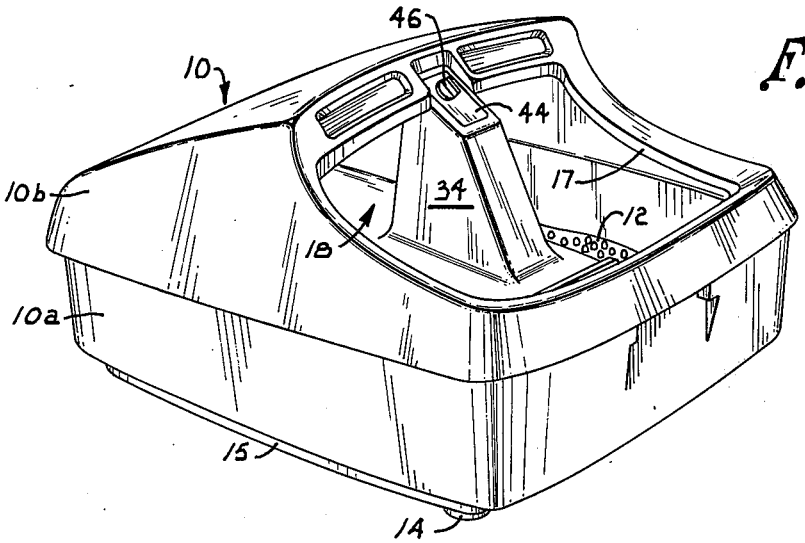
FIG. 1 is a perspective view of a hydrotherapy foot tub constructed in accordance with the invention.
Figure 2:
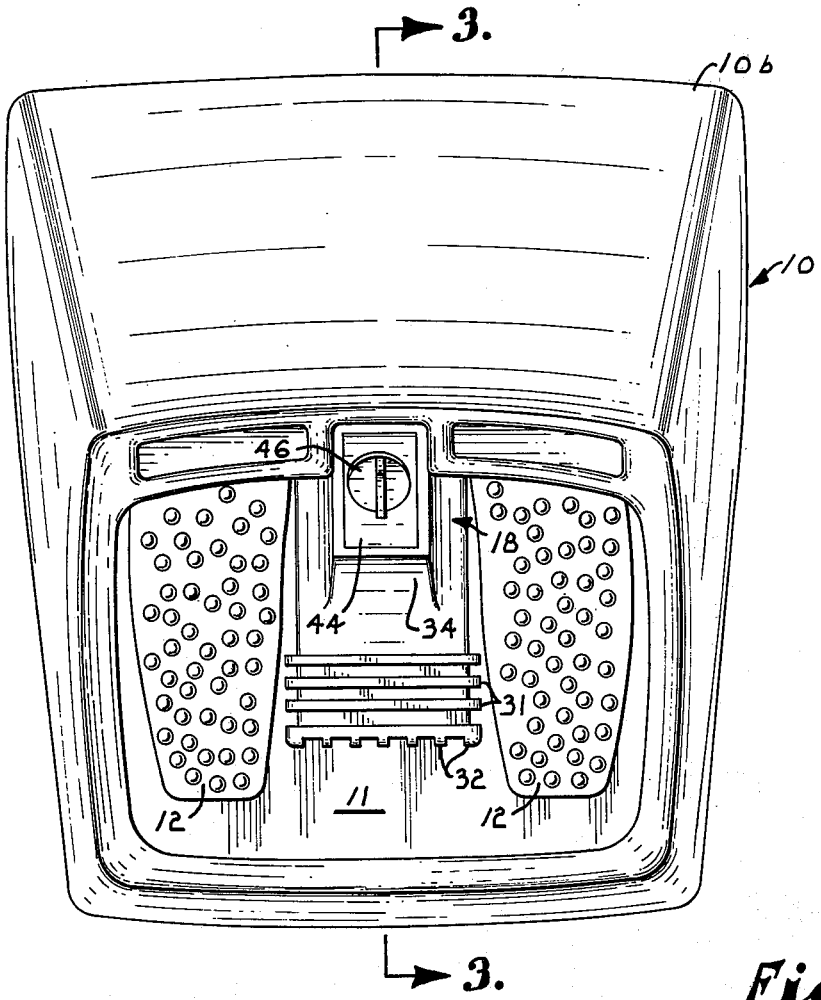
FIG. 2 is a top plan view on an enlarged scale of the foot tub shown in FIG. 1.

Referring now to the drawings in detail, the foot tub includes a casing which is generally designated by reference numeral 10 and includes a lower portion 10*a* and an upper portion 10*b*. The casing is preferably made of a suitable high grade molding plastic. The lower casing portion 10*a* has a floor 11 and upstanding side and end walls which provide a generally rectangular tub for containing liquid. Two embossed foot receiving sections 12 are raised slightly above floor 11. Sections 12 are shaped generally in accordance with the contour of the human foot and are spaced apart sufficiently to allow the user to place the feet thereon in a comfortable position.

The casing is supported on four short legs 13 which extend below floor 11 near the four corners thereof. Each leg 13 has a pad 14 on its lower end. A continuous peripheral downwardly extending flange 15 projects below floor 11 inwardly of its periphery and outwardly of legs 13.

The upper casing portion 10*b* is secured on top of the lower casing portion 10*a* and is constructed to overhang and cover approximately the forward half of the tub. Casing portion 10*b* is open directly above the rearward portions of foot receiving sections 12 in order to accommodate the legs of the user. An inwardly and downardly turned flange 17 extends around the open area to help retain liquid in the tub.

The tub is formed to include an integral console 18 which projects upwardly from floor 11 at a central location between the two foot receiving sections 12. Console 18 is substantially constant in width and extends from front to rear through a majority of the length of the casing, although the rearward end of the console is offset forwardly from the rear wall of the casing. The console is hollow and open at its lower end.

Figure 3:
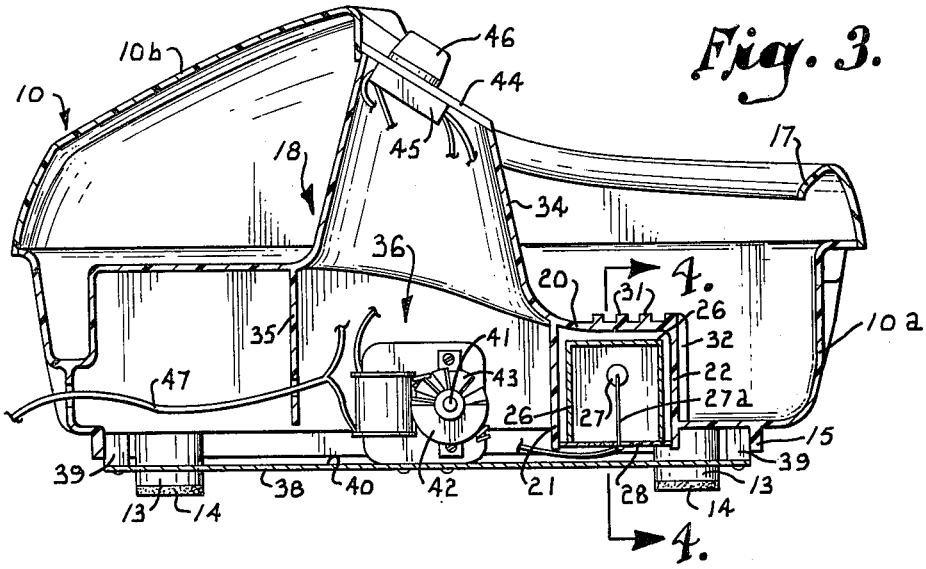
FIG. 3 is a cross-sectional elevational view taken generally along line 3—3 of FIG. 2 in the direction of the arrows.
Figure 4:
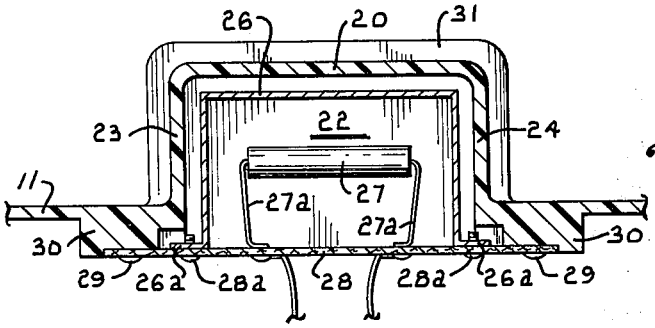
FIG. 4 is a cross-sectional view on an enlarged scale taken generally along line 4—4 of FIG. 3 in the direction of the arrows.

Referring to FIGS. 3 and 4, the forward portion of console 18 includes a horizontal top panel 20 which is spaced well above floor 11. A vertical wall 21 extends downwardly from top panel 20 internally of the console at a location forwardly of the back console wall 22. Walls 21 and 22 cooperate with top panel 20 and with the side walls 23 and 24 (FIG. 4) of the console to present an enclosed chamber of rectangular configuration in which the heater assembly is housed.

The heater assembly includes a hollow box-like member 26 which contains a heating element 27, preferably an electrical resistor having an output of approximately 40 watts. Member 26 is made of a heat conducting metal such as aluminum and is formed in a rectangular shape and initially open at the bottom. Heating element 27 is supported centrally within member 26 on top of upright conductors 27*a* which extend upwardly from a rectangular plate 28 to which the box-like member 26 is affixed by screws 28*a* to side flanges 26*a* on the lower end of member 26. The plate is electrically nonconducting, and thus is made of pressed mica or some other suitable substance. Exterior leads 27*b* are affixed to terminals in the plates which also connect with leads 27*a*. To complete the assembly of the heating unit and enclose the bottom of the heater housing, plate 28 is attached by screws 29 to bosses 30 formed on the underside of floor 11. Box member 26 is thus mounted within the console with a uniform clearance space of approximately ⅛ inch presented between the box member and walls 21, 22, 23 and 24 and top panel 20, while heating element 27 is supported inwardly of the walls and ceiling of member 26.

A plurality of spaced, parallel fins or ribs 31 extend continuously along the exterior surface of top panel 20 and side walls 23 and 24. End wall 22 of the console is likewise provided with a plurality of spaced vertical ribs 32. The ribs are preferably spaced about ¼ inch from one another and are important in eliminating burn hazards, as will be explained in more detail.

An upright columnar superstructure 34 is integral with console 18 and extends upwardly therefrom at a location forwardly of the internal console wall 21. The superstructure 34 is thus located substantially centrally on the entire unit. A vertical transverse partition wall 35 is formed internally of the console slightly beyond the forward end of the column. Superstructure 34 presents a hollow interior, the lower portion of which houses an electric vibrator motor 36 between the internal console walls 21 and 35.

With reference to FIG. 3, motor 36 is rigidly mounted centrally on the top side of a rectangular metal plate 38. Plate 38 is in turn screwed to the lower end of six bosses 39 in order to support the majority of the motor within the lower portion of column 34 and thus at a central location on the unit. Bosses 39 extend downwardly from floor 11 of the casing and are of a height to space plate 38 well below floor 11. A side vent 40 of considerable size is thereby formed on each side of the unit between plate 38 and the bottom of the casing to communicate motor 36 with the atmosphere for cooling purposes. Each vent 40 extends substantially the length of the casing and is preferably about ¾ inch in height.

Motor 36 drives a rotary output shaft 41 which carries eccentrics 42 on its opposite ends and is thus unbalanced. Shaft 41 also carries and drives a bladed fan 43 which acts to draw cooling air over the motor through the side vents 40.

The superstructure 34 extends substantially to the top of the casing. The upper terminus of the superstructure is elevated well above the level of the liquid that will be contained within the tub. A switch supporting panel 44 is secured on the top of the superstructure. The top forward edge of the column is raised somewhat above its top rearward edge such that panel 44 is inclined to face toward a user standing in the tub.

A switch for operating heating element 27 and motor 36 includes a switch housing 45 attached to the underside of panel 44 and a knob 46 located on the top side of the panel. The knob is secured to the end of a shaft (not shown) which extends from the switch housing through panel 44 and which operates the switch mechanism in a conventional manner. It is pointed out that knob 46 is located at the top central portion of the unit and is therefore accessible for convenient manipulation by a user standing in the tub.

The wiring for the unit includes a lead-in wire 47 which enters console 18 from the front of the casing and is provided with a plug (not shown) on its end for connection to a wall outlet. The wiring extends within the hollow interior of console 18 and the superstructure 34 to interconnect switch housing 45 with heating element 27 and motor 36 such that the switch can be set to operate the heating element and motor either alone or together. Accordingly, the switch is a four-way switch having an off setting, a heat only setting, a massage only setting and a heating and massage setting.

OPERATION

In use, the tub is filled to the desired level with water which may contain Epsom salts or the like. The user sets knob 46 appropriately if heating of the water is desired. The energized heating element 27 rapidly heats up the space within box member 26, and the heat is transferred through the box member to the clearance space surrounding same. Due to their uniform spacing from member 26, side walls 23 and 24, end wall 22, and top panel 20 receive substantially equal amounts of heat. The heat is distributed from the console walls and fins 31 and 32 such that the water in the vicinity of foot receiving sections 12 is heated to a uniform temperature at substantially the same rate.

As previously indicated, the heating element 27 is preferably a 40 watt resistor which is able to quickly heat the water to its operating temperature. It has been found that using conventional plastics, the outer surfaces of walls 22, 23 and 24 and top panel 20 reach a temperature in the range of 175° to 190°. However, ribs 31 and 32 reach a maximum temperature much less (150° at most). Even though the unit is intended for use with liquid in the tub, it is inevitable that it will occasionally be used without liquid. If the feet or ankles of the user are inadvertently moved against the walls of the console, they will contact only the lower temperature ribs and will not be burned as they might if they were to contact the warmer console walls.

If a massage is desired either alone or along with heating, the user standing in the tub need only reach down to set knob 46 in the appropriate position to activate motor 36 and initiate rotation of shaft 41. The unbalancing effect on shaft 41 provided by eccentrics 42 causes plate 38 to vibrate, and the vibration which is transmitted to the casing causes the casing and particularly floor 11 to vibrate in a vigorous manner. As shaft 41 rotates, fan 43 acts to draw a large volume flow of air through side vents 40 and over the motor which is thereby prevented from overheating.

From the foregoing it will be seen that this invention is well adapted to attain all the ends and objects hereinabove set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawing is to be interpreted as illustrative and not in a limiting sense.

Having thus described my invention, I claim:

1. Foot tub apparatus comprising:

a casing presenting a tub for receiving and containing liquid, said tub having a floor with foot spaces;

a heater housing supported between said foot spaces, said housing including generally upright walls extending upwardly from said floor and a top panel spaced above said floor, said walls and top panel cooperating to define a substantially enclosed chamber;

a heating element operable to emit heat;

a container member constructed of heat conducting material and lesser in size than said heater housing so that the exterior of said container member is spaced from the walls and top panel of said housing, said container member having said heating element therein; and means for mounting said container member within said heater housing.

2. Apparatus as set forth in claim 1, including a plurality of spaced ribs extending along the external walls of said heater housing and projecting outwardly therefrom.

3. Apparatus as set forth in claim 1, wherein said heating element comprises an electrical resistor supported within said container member and spaced from the interior walls thereof.

4. Apparatus as set forth in claim 1, including:

a substantially upright columnar superstructure extending above said floor between said foot spaces and having an upper portion elevated above said tub;

switch means for controlling the emission of heat from said heating element, said switch means including a switch actuator mounted on the upper portion of said superstructure; and conductor means extending from said switch means through the interior of said superstructure to said heating element.

5. Apparatus as set forth in claim 1, including:

an electrical vibrator motor mounted within said casing and operable to effect vibration of said floor;

means defining at least one air vent in said casing; and fan means operated by said motor to draw air through said vent and past said motor.

6. Apparatus as set forth in claim 5, including:

a substantially upright columnar superstructure extending above said floor between said foot spaces and having an upper portion elevated above said tub;

a switch mechanism for controlling the emission of heat from said heating element and the operation of said motor, said switch mechanism including a switch actuator mounted on the upper portion of said columnar superstructure; and wiring extending within said columnar superstructure to couple said switch mechanism with said heating element and motor.

7. Apparatus as set forth in claim 1, including:

a vibrator motor operable to effect vibration;

a fan driven by said motor to draw cooling air thereover; and a mounting plate rigidly mounting said motor thereon and secured to said casing in a manner to transmit the vibration of said motor to said floor, said mounting plate being spaced below said floor to cooperate therewith in defining air vents, whereby said fan operates to draw cooling air through said air vents and over said motor.

* * * * *